US008899795B2

(12) United States Patent
Tanaka et al.

(10) Patent No.: US 8,899,795 B2
(45) Date of Patent: Dec. 2, 2014

(54) LAMP DEVICE AND LIGHTING FIXTURE INCLUDING LED AS LIGHT SOURCE AND METALLIC COVER

(75) Inventors: Toshiya Tanaka, Yokohama (JP); Keiichi Shimizu, Yokohama (JP); Takumi Suwa, Ota-ku (JP); Makoto Sakai, Chigasaki (JP); Kozo Ogawa, Yokosuka (JP); Sigeru Osawa, Yokohama (JP); Takeshi Hisayasu, Ota-ku (JP); Hitoshi Kawano, Yokohama (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 118 days.

(21) Appl. No.: 13/063,871

(22) PCT Filed: Feb. 19, 2010

(86) PCT No.: PCT/JP2010/052489

§ 371 (c)(1),
(2), (4) Date: Jun. 14, 2011

(87) PCT Pub. No.: WO2010/095701

PCT Pub. Date: Aug. 26, 2010

(65) Prior Publication Data

US 2011/0291594 A1 Dec. 1, 2011

(30) Foreign Application Priority Data

Feb. 19, 2009 (JP) ..... 2009-037191

(51) Int. Cl.
*F21V 29/00* (2006.01)
*F21V 17/14* (2006.01)

(Continued)

(52) U.S. Cl.
CPC ..... *F21V 19/0005* (2013.01); *F21Y 2101/02* (2013.01); *F21V 17/14* (2013.01);

(Continued)

(58) Field of Classification Search
CPC ... F21V 29/004; F21V 29/22; F21V 29/2225; F21V 29/2231; F21V 29/2237; F21Y 2105/00; F21Y 2101/02
See application file for complete search history.

(56) References Cited

U.S. PATENT DOCUMENTS 7,132,805 B2 * 11/2006 Young ..... 315/308
7,226,189 B2 6/2007 Lee (Continued)

FOREIGN PATENT DOCUMENTS

CN 101310139 11/2008
DE 20 2008 016231 3/2009

(Continued)

OTHER PUBLICATIONS

Chinese Office Action issued in CN 201010111283.9 issued Jun. 26, 2012.

(Continued)

*Primary Examiner* — Sikha Roy
(74) *Attorney, Agent, or Firm* — DLA Piper LLP (US)

(57) ABSTRACT

In a lamp device 12 using a GX53-type cap 31 and also using an LED 56 as a light source, there is regulated an appropriate configuration of a metallic cover 32. A cap 31 and a lighting device 36 are arranged on an upper surface side of the metallic cover 32, and a substrate 33 on which the LED 56 is mounted is arranged on a lower surface side thereof. The metallic cover 32 has an approximately cylindrical shape with a maximum outer diameter D of 80 to 150 mm, a height H of 5 to 25 mm, and 2π (D/2) H/W, that is, an area of the outer peripheral surface per gross input power W to the lamp device 12 being in a range of 200 to 800 $mm^2$/W. The gross input power W is 5 to 20 W.

6 Claims, 6 Drawing Sheets

(51) Int. Cl.

| | |
|---|---|
| ***F21V 17/12*** | (2006.01) |
| ***F21V 19/00*** | (2006.01) |
| ***F21V 15/01*** | (2006.01) |
| ***F21K 99/00*** | (2010.01) |
| *F21Y 101/02* | (2006.01) |
| *F21Y 103/02* | (2006.01) |
| *F21V 11/06* | (2006.01) |
| *F21S 8/04* | (2006.01) |

(52) U.S. Cl.

CPC ..... *F21V 17/12* (2013.01); *F21V 29/2231* (2013.01); *F21Y 2103/022* (2013.01); *F21V 11/06* (2013.01); *F21S 8/04* (2013.01); *F21V 15/011* (2013.01); *F21K 9/30* (2013.01); *F21V 29/004* (2013.01)

USPC ..... 362/373; 362/362; 362/249.02; 362/546; 362/547

(56) References Cited

U.S. PATENT DOCUMENTS

| | | | | |
|---|---|---|---|---|
| 7,588,351 | B2 | 9/2009 | Meyer | |
| 7,670,021 | B2 | 3/2010 | Chou | |
| 7,800,119 | B2 | 9/2010 | He | |
| 7,874,699 | B2 | 1/2011 | Liang | |
| 7,914,162 | B1 | 3/2011 | Huang | |
| 7,950,826 | B2 | 5/2011 | Shin | |
| 7,959,329 | B2 | 6/2011 | Van De Ven | |
| 7,997,750 | B2 | 8/2011 | Chiang | |
| 8,292,477 | B2 * | 10/2012 | Juang et al. | 362/373 |
| 8,324,789 | B2 * | 12/2012 | Hisayasu et al. | 313/46 |
| 2006/0067077 | A1 | 3/2006 | Kumthampinij et al. | |
| 2006/0227558 | A1 | 10/2006 | Osawa | |
| 2007/0064421 | A1 * | 3/2007 | Baba | 362/231 |
| 2008/0084693 | A1 | 4/2008 | Shimada | |
| 2008/0158887 | A1 | 7/2008 | Zhu | |
| 2008/0186704 | A1 | 8/2008 | Chou | |
| 2009/0001558 | A1 * | 1/2009 | Shiau | 257/712 |
| 2009/0080187 | A1 | 3/2009 | Chou | |
| 2009/0086474 | A1 | 4/2009 | Chou | |
| 2009/0268470 | A1 | 10/2009 | Okimura | |
| 2009/0296387 | A1 | 12/2009 | Reisenauer | |
| 2010/0079075 | A1 | 4/2010 | Son | |
| 2010/0096992 | A1 | 4/2010 | Yamamoto | |
| 2011/0044042 | A1 | 2/2011 | Liu | |

FOREIGN PATENT DOCUMENTS

| | | |
|---|---|---|
| DE | 20 2009 001079 | 4/2009 |
| EP | 1950491 | 7/2008 |
| JP | 4-66009 | 10/1992 |
| JP | 5-250905 | 9/1993 |
| JP | 2002-347513 | 12/2002 |
| JP | 2003-016818 | 1/2003 |
| JP | 2006-040727 | 2/2006 |
| JP | 2006-172895 | 6/2006 |
| JP | 2007-157690 | 6/2007 |
| JP | 2007-335258 | 12/2007 |
| JP | 2008-140606 | 6/2008 |
| JP | 2008-243615 | 10/2008 |
| JP | 2008-257993 | 10/2008 |
| JP | 2008-311237 | 12/2008 |
| JP | 2009-037995 | 2/2009 |
| KR | 10-2008-0074179 | 8/2008 |
| TW | M341161 | 9/2008 |
| TW | 200840966 | 10/2008 |
| WO | WO2006/091538 | 8/2006 |
| WO | WO 2007/055380 | 5/2007 |
| WO | WO 2008/146694 | 12/2008 |

OTHER PUBLICATIONS

English Language Translation of Chinese Office Action issued in CN 201010111283.9 issued Jun. 26, 2012.
English Language Abstract of JP 2008-140606, published Jun. 19, 2008.
English Language Machine Translation of JP 2008-140606, published Jun. 19, 2008.
Extended European Search Report issued in EP 10001621.1 on Jun. 17, 2010.
English Language Abstract of JP 2008-257993 published Oct. 23, 2008.
English Language Translation of JP 2008-257993 published Oct. 23, 2008.
English Language Abstract of JP 2006-040727 published Feb. 9, 2006.
English Language Translation of JP 2006-040727 published Feb. 9, 2006.
English Language Abstract of JP 2007-157690 published Jun. 21, 2007.
English Language Translation of JP 2007-157690 published Jun. 21, 2007.
English Language Abstract of WO 2008/146694 published Dec. 4, 2008.
English language Abstract of JP 2009-037995 published Feb. 19, 2009.
English language Translation of JP 2009-037995 published Feb. 19, 2009.
European Search Report issued in EP 10164104 on Jul. 5, 2011.
Japanese Office Action issued in JP 2009-037190 on Aug. 15, 2012.
English Language Translation of Japanese Office Action issued in JP 2009-037190 on Aug. 15, 2012.
English Language Abstract of JP 4-66009 published Oct. 6, 1992.
English Language Abstract of JP 2006-172895 published Jun. 29, 2006.
English Language Translation of JP 2006-172895 published Jun. 29, 2006.
English Language Abstract of JP 2003-016818 published Jan. 17, 2003.
English Language Translation of JP 2003-016818 published Jan. 17, 2003.
English Language Abstract of JP 2002-347513 published Dec. 4, 2002.
English Language Translation of JP 2002-347513 published Dec. 4, 2002.
Chinese Office Action issued in CN 99103354 mailed Aug. 14, 2012.
English Translation of Chinese Office Action issued in CN 99103354 mailed Aug. 14, 2012.
English Language Abstract of TW M341161 published Sep. 21, 2008.
English Language Abstract of TW 200840966 published Oct. 16, 2008.
Chinese Office Action issued in CN201010188500.4 mailed Aug. 20, 2012.
English Language translation of Chinese Office Action issued in CN201010188500.4 mailed Aug. 20, 2012.
English Language Office Action issued in KR 10-2011-7005579 on Jul. 27, 2012.
English Language Abstract of KR 10-2008-0074179 published Aug. 12, 2008.
Japanese Office Action issued in JP 2009-037192 on Dec. 19, 2012.
English Language Translation of Japanese Office Action issued in JP 2009-037192 on Dec. 19, 2012.
English Language Abstract of JP 2008-311237 published Dec. 25, 2008.
English Language Translation of JP 2008-311237 published Dec. 25, 2008.
English Language Abstract of JP 05-250905 published Sep. 28, 1993.
English Language Translation of JP 05-250905 published Sep. 28, 1993.
English Language Abstract of JP 2008-243615 published Oct. 9, 2008.
English Language Translation of JP 2008-243615 published Oct. 9, 2008.
English Language Abstract of JP 2007-335258 published Dec. 27, 2007.

(56) References Cited

OTHER PUBLICATIONS

English Language Translation of JP 2007-335258 published Dec. 27, 2007.
Japanese Office Action issued in JP 2009-037191 on Dec. 19, 2012.
English Language Translation of Japanese Office Action issued in JP 2009-037191 on Dec. 19, 2012.
Chinese Office Action issued in CN 201010111283.9 on Jan. 16, 2013.
English Language Translation of Chinese Office Action issued in CN 201010111283.9 on Jan. 16, 2013.
Chinese Office Action issued in CN201080002760.6 on Dec. 27, 2012.
English Language Translation of Chinese Office Action issued in CN201080002760.6 on Dec. 27, 2012.
English Language Abstract of CN 101310139 published Nov. 19, 2008.
Korean Office Action issued in KR 10-2011-7005579 on Feb. 27, 2013.
English Language Translation of Korean Office Action issued in KR 10-2011-7005579 on Feb. 27, 2013.
Office Action issued in EP 10 001 621.1 mailed Apr. 8, 2013.
Extended European Search Report issued in EP 10743826.9 on Oct. 10, 2013.
Taiwanese Office Action issued in TW10220892200 on Jul. 8, 2013.
English Language Translation of Taiwanese Office Action issued in TW10220892200 on Jul. 8, 2013.
English Language Translation of WO 2007/055380 published May 18, 2007.
Japanese Office Action issued in JP 2009-037191 on Sep. 4, 2013.
English Language Translation of Japanese Office Action issued in JP 2009-037191 on Sep. 4, 2013.
U.S. Appl. No. 12/708,564.
U.S. Appl. No. 12/788,348.
U.S. Appl. No. 14/210,157.

* cited by examiner

LAMP DEVICE AND LIGHTING FIXTURE INCLUDING LED AS LIGHT SOURCE AND METALLIC COVER

TECHNICAL FIELD

The present invention relates to a lamp device using an LED as a light source and a lighting fixture using the lamp device.

BACKGROUND ART

Conventional lamp devices may use a GX53-type cap, for example. This lamp device is generally flat in shape. The GX53-type cap is provided on the upper surface side of the lamp device, and a metallic cover is arranged on the lower surface side thereof. A flat fluorescent lamp is arranged in the metallic cover as a light source. The metallic cover is separate from, but in contact with, the cap. A lighting circuit for lighting the fluorescent lamp is housed inside the cap. Heat generated by lighting of the fluorescent lamp is radiated outside from the metallic cover, thereby suppressing thermal influences on the lighting circuit, etc. (refer to, for example, PTL 1).

CITATION LIST

Patent Literature

PTL 1: Japanese Laid-Open Patent Publication No. 2008-140606

SUMMARY OF INVENTION

Technical Problem

When a lamp device is lit, a light source is heated. It is therefore necessary to irradiate the heat. In particular, where an LED generating more heat than a discharge lamp can radiate is used as a light source, a failure in sufficient heat radiation will result in an internal higher temperature of the LED. This can cause the LED to be thermally deteriorated and decreased in life duration. Therefore, sufficient heat radiation is necessary.

In a lamp device using the GX53-type cap, a fluorescent lamp has been used as a light source. Simply using an LED in place of a fluorescent lamp will not ensure sufficient heat radiation characteristics. Further, simply increasing heat radiation characteristics of a lamp device will cause the system to be made larger as a whole.

The present invention has been made in view of the above problems, an object thereof is to provide a lamp device capable of regulating an appropriate relationship between an LED and a metallic cover when the LED is used as a light source and a lighting fixture using the lamp device.

Solution to Problem

An embodiment of a lamp device described herein includes a substrate on which an LED chip is mounted, a lighting device for lighting the LED, and a metallic cover which has an approximately cylindrical shape with a maximum outer diameter D of 80 to 150 mm, a height H of 5 to 25 mm and $2\pi$ (D/2) H/W, that is, an area of an outer peripheral surface per gross input power W being in a range of 200 to 800 $mm^2/W$ and with which the substrate is installed so as to be brought into thermal contact.

The substrate may only have, for example, one surface which is flat and on which an LED chip is mounted and the other surface which can be brought into thermal contact with the metallic cover.

The lighting device may be arranged at any place.

The metallic cover is made of a metal having excellent thermal conductivity such as aluminum, and formed in an approximately cylindrical shape. The metallic cover may be provided with a substrate attachment portion with which the other surface side of the substrate is brought into surface contact and thermal contact. An outer peripheral portion of the metallic cover may be inclined in its cross sectional shape in a diametric direction or formed in a curved surface shape. Further, the metallic cover may be provided at an outer peripheral portion thereof with a plurality of fins for improving heat radiation characteristics or a through hole communicatively connected to the inside and the outside of the metallic cover.

The maximum outer diameter D of the metallic cover is in a range of 80 to 150 mm and preferably in a range of 85 to 100 mm. A range smaller than the above range is unable to secure a sufficient heat radiation area, whereas a range greater than the above range makes a lamp device and a lighting fixture using the lamp device larger in size.

The height H of the metallic cover is in a range of 5 to 25 mm and preferably in a range of 10 to 20 mm. A range thinner than the above range is unable to secure a sufficient heat radiation area and difficult in attachment/detachment operation, whereas a range thicker than the above range is unable to downsize the lamp device and the lighting fixture.

The metallic cover is in a range of 200 to 800 $mm^2/W$ in terms of $2\pi$ (D/2) H/W, that is, an area of the outer peripheral surface per gross input power W. An area of the outer peripheral surface may be an apparent surface area. And, even where the outer peripheral surface is inclined in its cross section to provide a tapered shape or provided with heat radiating fins to result in an increase in actual surface area, the outer peripheral surface is defined by the apparent surface area. A range smaller than 200 $mm^2/W$ is unable to obtain sufficient heat radiation performance, whereas a range greater than 800 $mm^2/W$ enlarges the size of the system.

For example, a cap such as the GX53-type cap, a reflection body for controlling light of an LED and a translucent cover for covering the LED may be provided. However, these are not essential constituents of the present invention.

An embodiment of a lamp device described herein includes a metallic cover having an approximately cylindrical shape with a maximum outer diameter D of 80 to 150 mm, a substrate which is installed so as to be brought into thermal contact with the metallic cover and in which a plurality of LED chips are mounted at the center of a center point of the metallic cover in the peripheral direction and the LED is mounted in such a range that the center of the LED is spaced away to the center of the metallic cover from an outermost edge thereof by (D/2)/3 or more and also spaced away to an outer edge of the metallic cover from the center thereof by (D/2)/4 or more, and a lighting device for lighting the LEDs mounted on the substrate in a range of gross input power W from 5 to 20 W.

The metallic cover is made of a metal having excellent thermal conductivity such as aluminum and formed in an approximately cylindrical shape. The metallic cover may be provided with a substrate attachment portion with which the other surface side of the substrate is brought into surface contact and thermal contact. In this instance, the "approximately cylindrical shape" means to include a polygonal column shape such as a square column shape or a pentagonal column shape and a conical trapezoid shape but preferably a polygonal column shape such as an octagonal or greater column shape and a cylindrical shape. An outer peripheral portion of the metallic cover may be inclined in its cross sectional shape in a diametric direction. Further, the metallic cover may be provided at an outer peripheral portion thereof with a plurality of fins for improving heat radiation characteristics or a through hole communicatively connected to the inside of the metallic cover. The maximum outer diameter D of the metallic cover is in a range of 80 to 150 mm and preferably in a range of 85 to 100 mm. A range smaller than the above range is unable to secure a sufficient heat radiation area, whereas a range greater than the above range enlarges the size of the system.

The substrate may only have, for example, one surface which is flat and on which an LED chip is mounted and the other surface which can be brought into thermal contact with the metallic cover. As long as two or more of a plurality of LEDs are mounted in the peripheral direction at the center of a center point of the metallic cover, any number is sufficient. And, the present invention is more preferable in a case where five or more of the LEDs are mounted.

The LED is mounted in such a range that the center of the LED is spaced away to the center of the metallic cover from an outermost edge thereof by (D/2)/3 or more and also spaced away to an outer edge of the metallic cover from the center thereof by (D/2)/4 or more. If the center of the LED is spaced away further to the center of the metallic cover than the above range, a distance between the LEDs is made shorter to result in an easy increase in temperature of the LEDs due to thermal influences. Further, a distance from the outer edge of the metallic cover is made greater to decrease heat radiation characteristics, thus resulting in a failure to obtain sufficient heat radiation performance. Still further, if the center of the LED is spaced away further to an outer edge of the metallic cover than the above range, heat radiation can be made efficient. However, the center of the metallic cover is decreased in brightness, by which the lamp device easily varies in brightness.

The lighting device may be arranged at any place, however, preferably housed inside the lamp device.

For example, a cap such as the GX53-type cap, a reflection body for controlling light of an LED and a translucent cover for covering the LED may be provided. However, these are not essential constituents of the present invention.

Embodiments of lamp device described herein may be lamp devices according to embodiments described above, further including a temperature sensitive element for detecting an internal temperature and in which the lighting device controls the output to the LED according to the internal temperature detected by the temperature sensitive element.

The temperature sensitive element may be arranged at any place such as a substrate side or a vicinity of the lighting device.

The lighting device allows the LED to light at a predetermined output, for example, the lighting device allows an internal temperature detected by the temperature sensitive element lower than a previously set reference temperature, and allows the LED to light at an output lower than the predetermined output if higher than the reference temperature.

Lamp device embodiments described above may be included in lighting fixtures. The lighting fixture described in Claim 6 is that which includes the lamp device described in Claim 2.

The lighting fixture may be provided with a fixture body, a socket device into which the lamp device is fitted, etc.

Advantageous Effects of Invention

According to an embodiment of the lamp device described herein, there is used a metallic cover with which a substrate at which LED chips are mounted is to be brought into thermal contact, and the metallic cover has an approximately cylindrical shape with a maximum outer diameter D of 80 to 150 mm, a height H of 5 to 25 mm, and $2\pi$ (D/2) H/W, that is, an area of the outer peripheral surface per gross input power W being in a range of 200 to 800 $mm^2$/W. Therefore, it is possible to secure heat radiation characteristics necessary for using the LEDs as a light source and also regulate an appropriate relationship between the LEDs and the metallic cover without enlarging the size of the system.

According to an embodiment of the lamp device described herein, there is used a metallic cover with which a substrate at which LED chips are mounted is brought into thermal contact, and the metallic cover has an approximately cylindrical shape with a maximum outer diameter D of 80 to 150 mm. A plurality of LEDs are mounted at the center of a center point of the metallic cover in the peripheral direction, and the LED is mounted in such a range that the center of the LED is spaced away to the center of the metallic cover from an outermost edge thereof by (D/2)/3 or more and also spaced away to an outer edge of the metallic cover from the center thereof by (D/2)/4 or more. Further, since the LEDs mounted on the substrate are lit in a range of gross input power W from 5 to 20 W, it is possible to secure heat radiation characteristics necessary for using the LEDs as a light source, suppress variance in brightness without enlarging the size of the lamp device and also regulate an appropriate relationship between the LED and the metallic cover.

According to the lamp device described in Claim 3, in addition to the effects of the lamp device described in Claim 1, output to the LED is controlled depending on an internal temperature detected by the temperature sensitive element. Therefore, it is possible to prevent an abnormal increase in temperature and also prolong the life of the LED.

According to lighting fixtures described herein, it is possible to provide a lighting fixture in which a lamp device is made longer in life and can be downsized.

DESCRIPTION OF EMBODIMENTS

Figure 1:
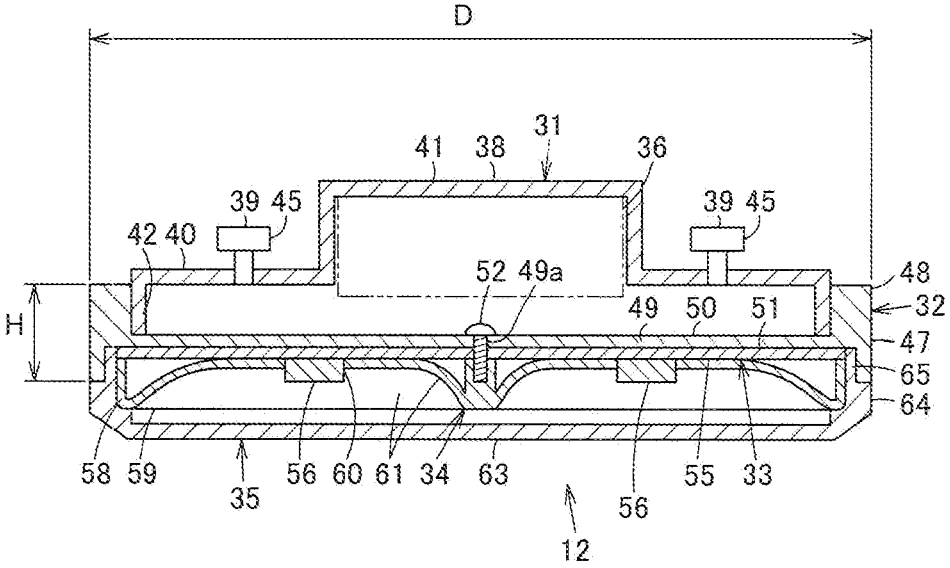
FIG. 1 is a cross sectional view which shows a lamp device of Embodiment 1 of the present invention.

Hereinafter, a description will be made for embodiments of the present invention by referring to the drawings.

Embodiment 1 is shown in FIG. 1 to FIG. 5.

Figure 4:
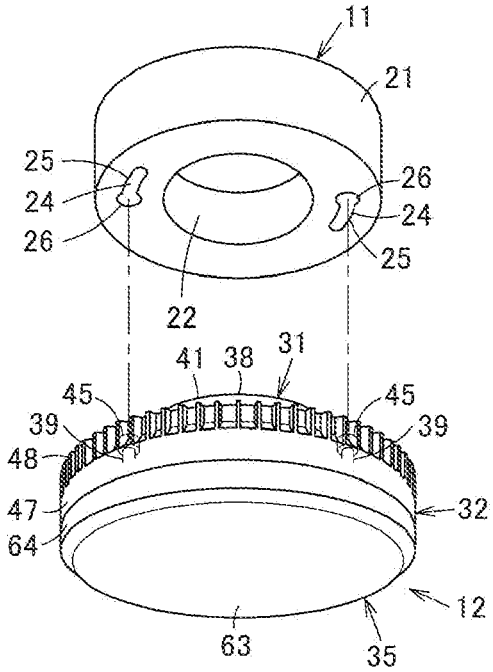
FIG. 4 is a perspective view of the lamp device and that of a socket device.

As shown in FIG. 4, the lighting fixture is provided, for example, with a fixture body (not shown) such as a downlight, a socket device 11 attached to the fixture body and a flat lamp device 12 fitted into the socket device 11. Hereinafter, regarding the direction such as the vertical direction, the following description will be made on the assumption that a cap side which is one surface side of the lamp device 12 is an upper side and a light source side which is the other surface side is a lower side on the basis of a state that the lamp device 12 is attached horizontally.

The socket device 11 is adapted for the GX53-type cap and made of an insulating synthetic resin. This device includes a cylindrical socket device body 21. And an insertion hole 22 is formed so as to penetrate at the center of the socket device body 21 in the vertical direction.

On a lower surface of the socket device body 21, a pair of socket portions 24 are formed at positions which are symmetrical with respect to the center of the socket device body 21. A connection hole 25 is formed on each of the socket portions 24, and a holder (not shown) for supplying power is provided inside the connection hole 25. The connection hole 25 is a circular long hole which is a concentric circle with respect to the center of the socket device body 21, and a large diameter hole 26 is formed at one end of the long hole.

Further, as shown in FIG. 1 to FIG. 4, the lamp device 12 includes a cap 31 arranged on an upper surface side, a metallic cover 32 having the cap 31 attached on the upper surface side, a substrate 33 which is an LED module substrate attached on the lower surface side of the metallic cover 32 so as to be brought into thermal contact therewith, a reflection body 34 attached to the metallic cover 32 via the substrate 33, a translucent cover 35 which is a globe attached to cover the lower surface of the metallic cover 32, and a lighting device 36 arranged inside the cap 31. These parts are individually formed so as to be dimensionally thin and small in the height direction.

For example, the GX53-type cap is adopted as the cap 31. The cap 31 includes a cap case 38 made of an insulating synthetic resin and a pair of lamp pins 39 projected from an upper surface of the cap case 38. An outer diameter of the cap 31 is approximately 70 to 75 mm.

In the cap case 38, a flat and disk-shaped (annular) substrate portion 40, a cylindrical projection portion 41 projected upward from the center of an upper surface of the substrate portion 40, and an annular fitting portion 42 projected downward from a peripheral portion of the substrate portion 40 are integrally formed. A pair of attachment bosses 43 for attaching the pair of lamp pins 39 and a plurality of insertion holes 44 are formed at the substrate portion 40. Then, the fitting portion 42 is fitted into the metallic cover 32 and a plurality of screws (not shown) are screwed into the metallic cover 32 through the respective insertion holes 44 from the outside of the substrate portion 40, by which the cap case 38 is fixed to the metallic cover 32.

The pair of lamp pins 39 are positioned symmetrically with respect to the center of the lamp device 12, and projected from the upper surface of the substrate portion 40 of the cap case 38. A large diameter portion 45 is formed at the leading end of the lamp pins 39. Then, the large diameter portion 45 of each of the lamp pins 39 is inserted from the large diameter hole 26 of each connection hole 25 of the socket device 11, and the lamp device 12 is turned at a predetermined angle, for example, approximately 10°. Thus, the lamp pin 39 is moved from the large diameter hole 26 to the connection hole 25 and electrically connected to the holder arranged inside the connection hole 25. At the same time, the large diameter portion 45 is hooked on an edge of the connection hole 25. Thereby, the lamp device 12 is held by the socket device 11.

Further, the metallic cover 32 is made of a metallic material having excellent thermal conductivity such as aluminum, and integrally formed so as to have a flat and approximately cylindrical shape. The metallic cover 32 has an outer peripheral portion 47 formed in an approximately cylindrical shape, and at the outer peripheral portion 47, a plurality of heat radiating fins 48 are formed over approximately half the region of the upper part side thereof, which is the cap side.

Inside the outer peripheral portion 47, a discoidal substrate attachment portion 49 is formed in the middle of the vertical direction. Divided by the substrate attachment portion 49, a cap side space 50 where the fitting portion 42 of the cap case 38 is to be fitted is formed on the upper surface side of the metallic cover 32, and a light source side space 51 where the substrate 33, the reflection body 34, etc., are arranged is formed on the lower surface side thereof. At the center of the substrate attachment portion 49, an attachment hole 49*a* for fixing the reflection body 34 with a screw is formed. An attachment screw 52 is inserted into the attachment hole 49*a* from the cap case 38 side of the substrate attachment portion 49, the attachment screw 52 is screwed at the center of the reflection body 34, by which the reflection body 34 is fixed to the metallic cover 32. The substrate 33 which is positioned by being fitted into an internal configuration of the reflection body 34 is fixed so as to be held by the reflection body 34 and allowed to be brought into contact with the substrate attachment portion 49. Further, a wiring hole 49*b* for connecting the substrate 33 with the lighting device 36 by using a lead wire is formed at the substrate attachment portion 49.

The maximum outer diameter D of the outer peripheral portion 47 of the metallic cover 32 is 80 to 150 mm, preferably 85 to 100 mm and specifically to the extent of 90 mm. Further, the height H of the outer peripheral portion 47 of the metallic cover 32 is 5 to 25 mm, preferably 10 to 20 mm, and specifically to the extent of 17 mm. Still further, $2\pi$ (D/2) H/W, which is an area of the outer peripheral surface of the outer peripheral portion 47 per gross input power W to the lamp device 12 is in a range of 200 to 800 $mm^2/W$.

Further, the substrate 33 has a substrate body 55 formed to have a flat and disk shape which is made of a metallic material having excellent thermal conductivity such as aluminum. On a lower surface of the substrate body 55, a wiring pattern is formed via an insulation layer, and a plurality of LEDs 56, that is, LED chip elements, are electrically and mechanically connected and arranged on the wiring pattern. The substrate body 55 is held between the metallic cover 32 and the reflection body 34 which is screwed to the metallic cover 32 and thereby attached to a lower surface of the substrate attachment portion 49 of the metallic cover 32 so as to be brought into close surface contact therewith to enable thermal conduction.

Figure 2:
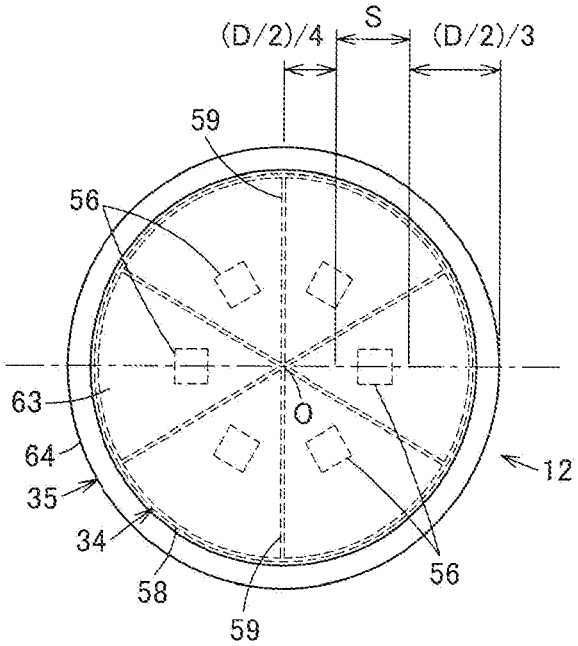
FIG. 2 is a front view of the lamp device when viewed from the translucent cover side.
Figure 3:
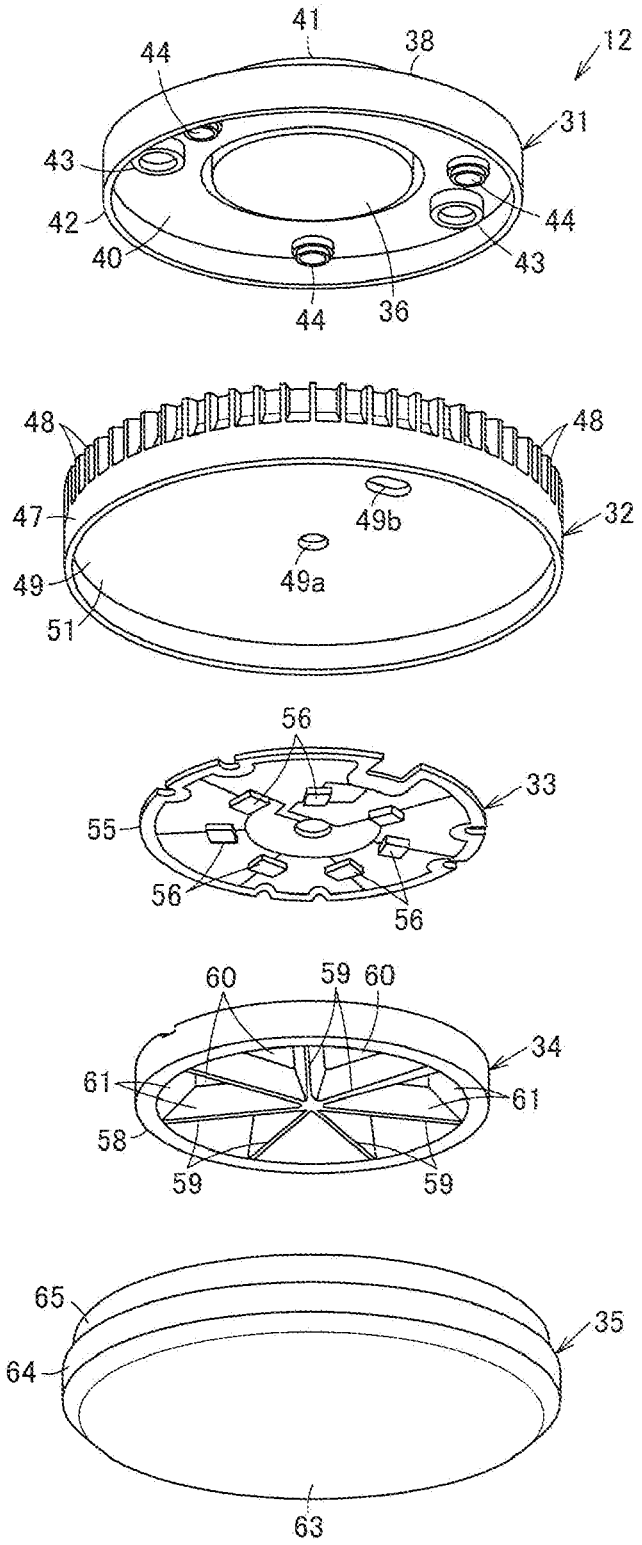
FIG. 3 is a perspective view of the lamp device in a state of being disassembled.

The plurality of LEDs 56 are mounted, along the peripheral direction at the center of a center point O of the metallic cover 32, on the substrate body 55 (FIG. 2 and FIG. 3 show respectively the cases of six and seven of them). Further, the LED 56 is mounted in such a range S that the center of the LED 56 is spaced away to the center of the metallic cover 32 from an outermost edge thereof by (D/2)/3 or more and also spaced away to an outer edge of the metallic cover from the center thereof by (D/2)/4 or more.

Further, the reflection body 34 is made of a synthetic resin, for example, and formed to have a reflecting face having high reflection efficiency such as a white-colored mirror surface. In a peripheral portion of the reflection body 34, a cylindrical frame portion 58 is formed, and inside the frame portion 58, a divider 59 for dividing the inside of the reflection body 34 for each of the LEDs 56 is formed in a radial manner. An aperture 60 through which the LED 56 penetrates and a reflecting face 61 which faces the LED 56 to reflect light from the LED 56 to a desired direction in accordance with light distribution are formed inside the reflection body 34 which is divided by the frame portion 58 and the divider 59 for each of the LEDs 56.

The reflection body 34 is arranged on a lower surface of the metallic cover 32 via the substrate 33 and fastened and fixed to the metallic cover 32 by the attachment screw 52 which is screwed to the center of the reflection body 34 from an upper surface side of the metallic cover 32 through the attachment hole 49*a*. The reflection body 34 is fastened and fixed to the metallic cover 32, by which the substrate 33 is held between the reflection body 34 and the metallic cover 32 so that the substrate 33 is brought into close contact with the substrate attachment portion 49 of the metallic cover 32.

Further, the translucent cover 35 is made of a transparent synthetic resin having translucency or light diffusion property. The translucent cover 35 includes a discoidal front surface portion 63 and a cylindrical side surface portion 64 installed on a peripheral portion of the front surface portion 63. On the side surface portion 64, there is formed a fitting portion 65 which is fitted into the outer peripheral portion 47 of the metallic cover 32 and adhered and fixed by using an adhesive agent.

Further, the lighting device 36 includes a circuit substrate and a plurality of lighting circuit components (not shown) mounted on the circuit substrate and arranged inside the projection portion 41 of the cap case 38. A power supply input portion of the lighting device 36 and the pair of lamp pins 39 are electrically connected by a lead wire (not shown) and an output part of the lighting device 36 and the substrate 33 are electrically connected by a lead wire (not shown) through the wiring hole 49*b* of the metallic cover 32.

Then, in order to fit the thus structured lamp device 12 into the socket device 11, each of the lamp pins 39 of the lamp device 12 is inserted into the large diameter hole 26 of each connection hole 25 of the socket device 11 from below, and subsequently the lamp device 12 is turned in the fitting direction. Then, each of the lamp pins 39 is moved from each large diameter hole 26 to each connection hole 25, by which each of the lamp pins 39 is electrically brought into contact with the holder of the socket device 11 and also the large diameter portion 45 of each of the lamp pins 39 is hooked on an edge portion of each connection hole 25. Thus, the lamp device 12 can be fitted into the socket device 11.

In a state that the lamp device 12 is fitted into the socket device 11, the projection portion 41 of the lamp device 12 is inserted into the insertion hole 22 of the socket device 11. At this time, if an edge surface of the projection portion 41 or the metallic cover 32 is brought into close contact with the fixture body (not shown) so as to enable thermal conduction, heat of the lamp device 12 can be released to the fixture body.

Further, when the LED 56 of the lamp device 12 is lit, heat generated by the LED 56 is thermally conducted from the substrate 33 to the substrate attachment portion 49 of the metallic cover 32 and then from the substrate attachment portion 49 to the outer peripheral portion 47. The heat thus thermally conducted to the outer peripheral portion 47 of the metallic cover 32 is efficiently radiated from the outer peripheral surface of the outer peripheral portion 47 into air. In particular, since the heat radiating fin 48 is provided at the outer peripheral portion 47, the surface area of the outer peripheral portion becomes larger than a plain surface, thus making it possible to improve heat radiation efficiency. Here, the outer peripheral portion 47 may be free of the heat radiating fin 48 and may give a plain side surface, as long as it is able to achieve satisfactory heat radiation performance.

Then, in the lamp device 12, there is used the metallic cover 32 with which the substrate 33 on which the LEDs 56 are mounted is brought into thermal contact, and the metallic cover 32 has an approximately cylindrical shape with a maximum outer diameter D of 80 to 150 mm, preferably 85 to 100 mm, a height H of 5 to 25 mm, preferably 10 to 20 mm, and $2\pi$ (D/2) H/W, that is, an area of the outer peripheral surface per gross input power W, being in a range of 200 to 800 $mm^2/W$.

If the maximum outer diameter D of the metallic cover 32 is smaller than 80 mm, a sufficient heat radiation area is not secured on the outer peripheral surface 47 of the metallic cover 32. Further, if it is greater than 150 mm, the lamp device 12 is made large in size.

If the height H of the metallic cover 32 is thinner than 5 mm, a sufficient heat radiation area is not secured on the outer peripheral surface 47 of the metallic cover 32, and attachment/detachment operation is also made difficult. Further, if it is thicker than 25 mm, the lamp device 12 cannot be downsized.

Figure 5:
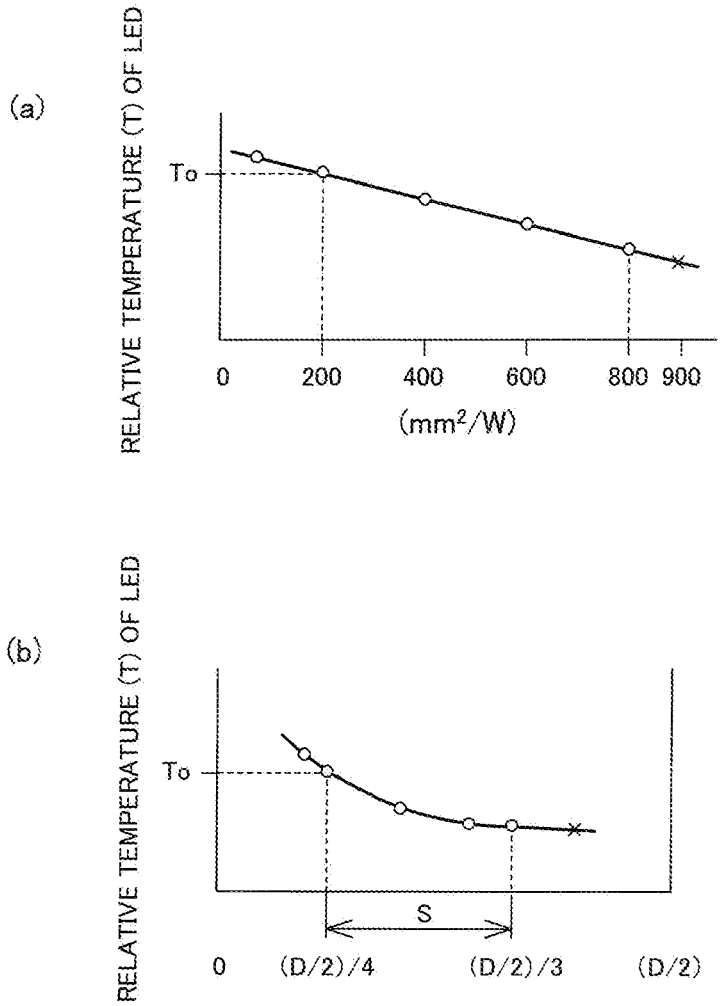
FIG. 5 shows graphs of characteristics of the lamp device. More particularly, FIG. 5 (*a*) is a graph which shows a relationship between an area of an outer peripheral surface of a metallic cover per gross input power to the lamp device and a relative temperature of an LED, whereas FIG. 5 (*b*) is a graph which shows a relationship between an arrangement position of the LED and a relative temperature of the LED.

As shown in FIG. 5 (*a*), where $2\pi$ (D/2) H/W, which is an area of the outer peripheral surface of the outer peripheral portion 47 of the metallic cover 32 per gross input power W to the lamp device 12, is smaller than 200 $mm^2/W$, the metallic cover 32 fails to provide sufficient heat radiation performance to exceed a permissible temperature $T_O$ of the LED 56. Further, where $2\pi$ (D/2) H/W is greater than 800 $mm^2/W$, the lamp device 12 is increased in outer diameter or height, the lamp device 12 is made large in size. The lamp device 12 failed in an appearance evaluation test (in FIG. 5 (*a*), O indicates acceptable, whereas X indicates not acceptable).

Therefore, in the lamp device 12, there is used the metallic cover 32 with which the substrate 33 at which the LED 56 is mounted is brought into thermal contact, and the metallic cover 32 has an approximately cylindrical shape with a maximum outer diameter D of 80 to 150 mm, preferably 85 to 100 mm, a height H of 5 to 25 mm, preferably 10 to 20 mm, and $2\pi$ (D/2) H/W, that is, an area of the outer peripheral surface per gross input power W being in a range of 200 to 800 $mm^2/W$. Therefore, it is possible to secure heat radiation characteristics necessary for using the LED 56 as a light source and also regulate an appropriate relationship between the LED 56 and the metallic cover 32 without decreasing the life of the LED 56 or enlarging the size of the system.

In the lamp device 12, there is used the metallic cover 32 with which the substrate 33 on which the LED 56 is mounted is brought into thermal contact, and the metallic cover 32 has an approximately cylindrical shape with a maximum outer diameter D of 80 to 150 mm. Then, a plurality of LEDs 56 are mounted in the peripheral direction at the center of a center point O of the metallic cover 32. The LED 56 is mounted in such a range S that the center of the LED 56 is spaced away to the center of the metallic cover 32 from an outermost edge thereof by (D/2)/3 or more and also spaced away to an outer edge of the metallic cover 32 from the center thereof by (D/2)/4 or more. In this way, the LEDs 56 mounted on the substrate 33 are lit in a range of gross input power W from 5 to 20 W.

In this instance as well, if the maximum outer diameter D of the metallic cover 32 is smaller than 80 mm, a sufficient heat radiation area is not secured on the outer peripheral surface 47 of the metallic cover 32. Further, if it is greater than 150 mm, the lamp device 12 is made large in size.

As shown in FIG. 5 (*b*), if the center of the LED 56 is not spaced away to the center of the metallic cover 32 from the outermost edge (D/2) by (D/2)/3 or more but positioned at an outer edge of the metallic cover 32, heat radiation can be made efficient. However, the center of the metallic cover 32 is decreased in brightness, by which the lamp device 12 easily varies in brightness. The lamp device 12 failed in a brightness variance evaluation test (in FIG. 5 (*b*), O indicates acceptable, whereas X indicates not acceptable). Further, if the center of the LED 56 is not spaced away to the outer edge of the metallic cover 32 from the center thereof O by (D/2)/4 or more but positioned at the center of the metallic cover 32, a distance between the LEDs 56 is made shorter to result in an easy increase in temperature of the LEDs 56 due to thermal influences. Further, a distance from the outer edge of the metallic cover 32 is made greater to decrease heat radiation characteristics, thus resulting in a failure to have sufficient heat radiation performance. As a result, the temperature of the LEDs 56 was in excess of a permissible temperature $T_O$.

Therefore, in the lamp device, there is used the metallic cover 32 with which the substrate 33 on which the LEDs 56 are mounted is brought into thermal contact, and the metallic cover 32 has an approximately cylindrical shape with a maximum outer diameter D of 80 to 150 mm. A plurality of LEDs 56 are mounted in the peripheral direction at the center of the center point O of the metallic cover 32. The LED 56 is mounted in such a range that the center of the LED 56 is spaced away to the center of the metallic cover 32 from an outermost edge thereof by (D/2)/3 or more and also spaced away to an outer edge of the metallic cover 32 from the center thereof by (D/2)/4 or more. And, the LEDs 56 mounted on the substrate 33 are lit in a range of gross input power W from 5 to 20 W, thus making it possible to secure heat radiation characteristics necessary for using the LEDs 56 as a light source. It is also possible to suppress the occurrence of variance in brightness without making the lamp device 12 large in size and also regulate an appropriate relationship between the LEDs 56 and the metallic cover 32.

Figure 6:
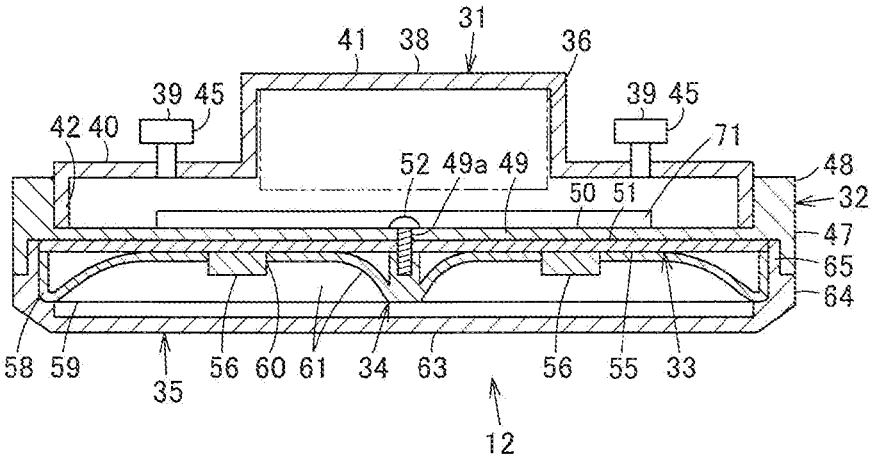
FIG. 6 is a cross sectional view which shows a lamp device of Embodiment 2.

Next, Embodiment 2 is shown in FIG. 6.

A temperature sensitive element 71 is arranged inside the lamp device 12. The temperature sensitive element 71 is positioned opposite a surface to which the substrate 33 of the substrate attachment portion 49 of the metallic cover 32 is attached.

The lighting device 36 controls output to the LED 56 depending on an internal temperature detected by the temperature sensitive element 71. That is, where the internal temperature detected by the temperature sensitive element 71 is lower than a previously set reference temperature, the LED 56 is lit at a predetermined output. Where it is higher than the reference temperature, the LED 56 is lit at an output lower than the predetermined output.

As described above, the output to the LED 56 is controlled depending on an internal temperature of the lamp device 12 detected by the temperature sensitive element 71. Thereby, it is possible to prevent the internal temperature of the lamp device 12 from being increased due to an increase in atmospheric temperature of the lamp device 12 and also prevent an abnormal increase in temperature of the LED 56 in excess of an ordinary temperature range, thus prolonging the life of the LED 56.

Figure 7:
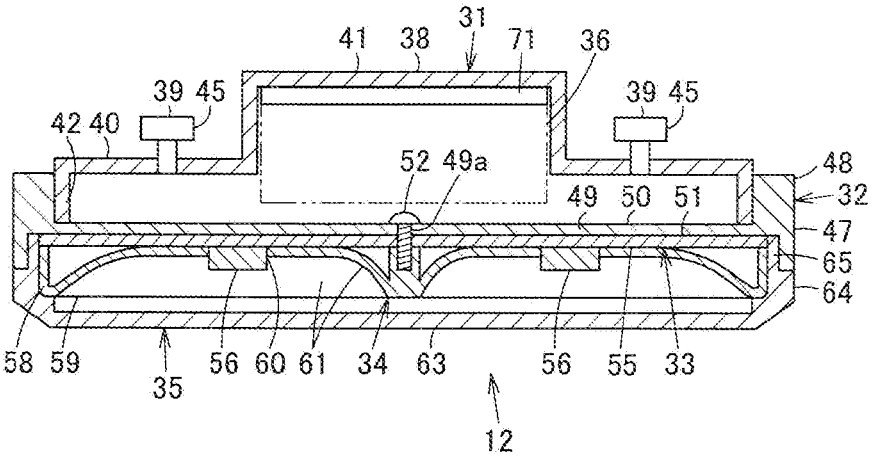
FIG. 7 is a cross sectional view of a lamp device of Embodiment 3.

Next, Embodiment 3 is shown in FIG. 7.

As with Embodiment 2 shown in FIG. 6, a temperature sensitive element 71 is used to control temperatures. However, the temperature sensitive element 71 is positioned inside the cap 31 at which the lighting device 36 is arranged.

It is, thereby, possible to prevent an abnormal increase in temperature of the lighting device 36 due to heat from the LED 56 in excess of an ordinary temperature range and also prolong the life of the LED 56 and that of the lighting device 36.

Figure 8:
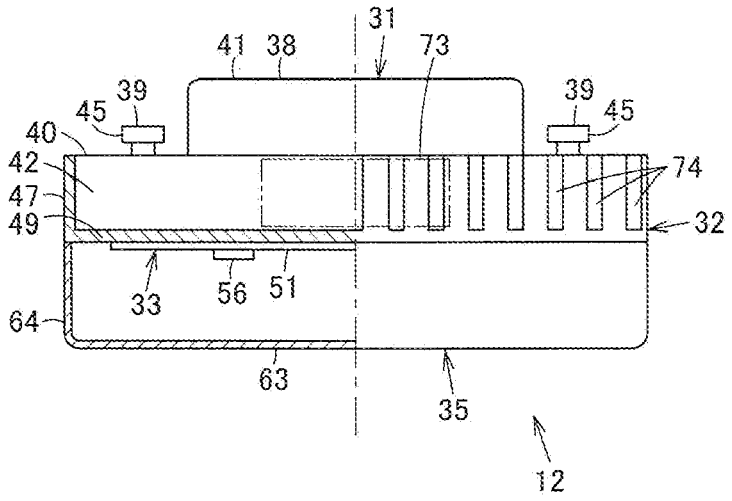
FIG. 8 is a cross sectional view of a lamp device of Embodiment 4.

Next, Embodiment 4 is shown in FIG. 8.

A fan 73 is arranged at a cap side space 50 of the metallic cover 32, and the metallic cover 32 is provided with a plurality of slit-shaped ventilation holes 74 through which air supplied by the fan 73 is ventilated. Where a fitting portion 42 of the cap case 38 is structured so as to be fitted into the cap side space 50 of the metallic cover 32, the fitting portion 42 is also provided with a plurality of ventilation holes communicatively connected to the ventilation holes 74 of the metallic cover 32.

Then, the fan 73 is used to discharge heat inside the metallic cover 32 to the outside through the ventilation holes 74 and bring outdoor air lower in temperature into the metallic cover 32. Further, the metallic cover 32 is cooled forcibly, thus making it possible to improve the heat radiation performance of the metallic cover 32. Therefore, for example, in the case of a downlight where the lighting fixture easily contains heat, and natural convection alone decreases heat radiation characteristics of the metallic cover 32, the forcible cooling is conducted to secure the heat radiation characteristics.

Figure 9:
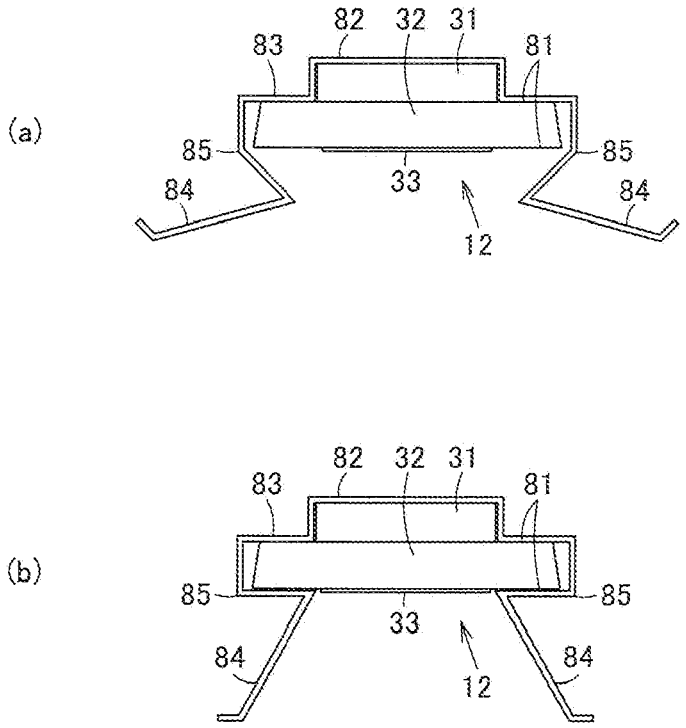
FIG. 9 shows Embodiment 5. More particularly, FIG. 9 (*a*) is a cross sectional view which shows that the lamp device is in the process of being attached to a fixture body, whereas FIG. 9 (*b*) is a cross sectional view in which the lamp device is attached to the fixture body.

Next, Embodiment 5 is shown in FIG. 9.

The lamp device 12 is that in which the reflection body 34 or the translucent cover 35 is not installed and the substrate 33 is exposed. A contact portion 81 which is in contact with a device side is installed on an upper surface peripheral portion of the metallic cover 32 and a lower surface peripheral portion thereof.

The lighting fixture is, for example, a downlight, which includes a fixture body 82 and a cylindrical reflection plate (not shown) attached to the fixture body 82.

The fixture body 82 includes a lamp attachment portion 83 to which the lamp device 12 is attached and a reflection plate attachment portion 84 to which the reflection plate is attached.

The lamp device 12 is attached to the lamp attachment portion 83 so that the contact portion 81 at an upper surface peripheral portion of the metallic cover 32 is brought into contact therewith to enable thermal conduction.

The reflection plate attachment portion 84 is divided into a plurality of parts in the peripheral direction, each of which is installed at the lamp attachment portion 83 so as to be opened and closed with each other by a spring-shaped hinge 85. Then, as shown in FIG. 9 (*a*), the plurality of reflection plate attachment portions 84 are opened outside, thus making it possible to attach the lamp device 12 to the lamp attachment portion 83. Further, after attachment of the lamp device 12, as shown in FIG. 9 (*b*), the plurality of reflection plate attachment portions 84 are closed to the center side, by which the plurality of reflection plate attachment portions 84 are brought into contact with the contact portion 81 at the lower surface peripheral portion of the metallic cover 32 to enable thermal conduction. Metallic reflection plates can also be attached to the plurality of reflection plate attachment portions 84.

Then, in an assembly state, the metallic cover 32 of the lamp device 12, the metallic fixture body 82 and the metallic reflection plates are brought into contact with each other to enable thermal conduction. Thereby, heat generated by the lamp device 12 can be conducted for heat radiation to the fixture body 82 and the reflection plates.

INDUSTRIAL APPLICABILITY

The present invention is applicable to a lamp device in which an LED is used as a light source and to a lighting fixture using the lamp device.

REFERENCE SIGNS LIST

12 Lamp device
32 Metallic cover
33 Substrate

36 Lighting device
56 LED
71 Temperature sensitive element

The invention claimed is:

1. A lamp device comprising:
a substrate on which an LED chip is mounted;
a lighting device for lighting the LED; and
a metallic cover comprising:
a planar substrate attachment portion with which the substrate is brought into thermal contact and which separates the substrate and the lighting device,
an outer peripheral portion:
extending continuously in a radially outward direction from the planar substrate attachment portion in the plane of the substrate attachment portion,
projected in a vertical direction with respect to a surface of the substrate attachment portion, a lower side of the outer peripheral portion being projected lower in the vertical direction than the substrate attachment portion, and
formed in a cylindrical shape,
wherein an upper side face of the outer peripheral portion defines a maximum outer diameter of the metallic cover, the maximum outer diameter of the metallic cover being greater than a height of the metallic cover,
a cover attachment portion disposed on the lower side of the outer peripheral portion and arranged lower in the vertical direction than the substrate attachment portion, and
heat radiating fins disposed on an upper side of the outer peripheral portion,
wherein heat generated by the LED is conducted to the outer peripheral portion from the substrate attachment portion and radiated into air from the outer peripheral surface of the outer peripheral portion;
a cap comprising:
a cap case comprising an annular substrate portion and a cylindrical projection portion projected in a vertical direction with respect to the surface of the substrate attachment portion from the center of an upper surface of the annular substrate portion, wherein the lighting device is disposed inside the cap case, and
lamp pins which are configured to supply power to the lighting device and are disposed in the annular substrate portion radially outside the projection portion; and
a translucent cover attached to the cover attachment portion.

2. A lamp device comprising:
a metallic cover comprising:
a planar substrate attachment portion configured to thermally contact a substrate,
an outer peripheral portion:
extending continuously in a radially outward direction from the planar substrate attachment portion in the plane of the substrate attachment portion,
projected in a vertical direction with respect to a surface of the substrate attachment portion, a lower side of the outer peripheral portion being projected lower in the vertical direction than the substrate attachment portion, and
formed in a cylindrical shape,
wherein an upper side face of the outer peripheral portion defines a maximum outer diameter of the metallic cover, the maximum outer diameter of the metallic cover being greater than a height of the metallic cover,
a cover attachment portion disposed on the lower side of the outer peripheral portion and arranged lower in the vertical direction than the substrate attachment portion, and
heat radiating fins disposed on an upper side of the outer peripheral portion,
wherein heat from the substrate is conducted to the outer peripheral portion from the substrate attachment portion and radiated into air from the outer peripheral surface of the outer peripheral portion;
the substrate which is installed so as to be brought into thermal contact with the metallic cover and on which a plurality of LED chips are mounted at a center point of the metallic cover in the peripheral direction and the LED chips are mounted such that a center of each of the LED chips is spaced towards the center of the metallic cover from an outermost edge of the metallic cover by (D/2)/3 or more and spaced towards an outer edge of the metallic cover from the center of the metallic cover by (D/2)/4 or more;
a lighting device configured for lighting LEDs of the LED chips mounted on the substrate in a range of gross input power W from 5 to 20 W;
a cap comprising:
a cap case comprising an annular substrate portion and a cylindrical projection portion projected in a vertical direction with respect to the surface of the substrate attachment portion from the center of an upper surface of the annular substrate portion, wherein the lighting device is disposed inside the cap case, and
lamp pins which are configured to supply power to the lighting device and are disposed in the annular substrate portion radially outside the projection portion; and
a translucent cover attached to the cover attachment portion.

3. The lamp device according to claim 1, further including a temperature sensitive element for detecting an internal temperature, wherein the lighting device is configured to control output to the LED depending on an internal temperature detected by the temperature sensitive element.

4. The lamp device according to claim 2, further including a temperature sensitive element for detecting an internal temperature, wherein the lighting device is configured to control output to the LEDs depending on an internal temperature detected by the temperature sensitive element.

5. A lighting fixture including the lamp device according to claim 1.

6. A lighting fixture including the lamp device according to claim 2.

* * * * *